US012516528B1

(12) United States Patent
Collins

(10) Patent No.: US 12,516,528 B1
(45) Date of Patent: Jan. 6, 2026

(54) BRICK TRAY

(71) Applicant: Steven J. Collins, Cranston, RI (US)

(72) Inventor: Steven J. Collins, Cranston, RI (US)

( * ) Notice: Subject to any disclaimer, the term of this patent is extended or adjusted under 35 U.S.C. 154(b) by 220 days.

(21) Appl. No.: 18/196,771

(22) Filed: May 12, 2023

Related U.S. Application Data

(60) Provisional application No. 63/341,026, filed on May 12, 2022, provisional application No. 63/341,033, filed on May 12, 2022.

(51) Int. Cl.
*E04F 13/08* (2006.01)

(52) U.S. Cl.
CPC ..... *E04F 13/0805* (2013.01); *E04F 13/0862* (2013.01)

(58) Field of Classification Search
CPC ..... E04F 13/0805; E04F 13/0862
See application file for complete search history.

(56) References Cited

U.S. PATENT DOCUMENTS 421,742 A * 2/1890 Marsh ..... E04F 13/0862 52/387
2,031,680 A * 2/1936 Tuthill ..... E04F 13/0801 52/387
2,043,706 A * 6/1936 Myers ..... E04F 13/0803 52/387
2,087,931 A * 7/1937 Wallace ..... E04F 13/0803 52/387
2,924,963 A * 2/1960 Taylor ..... E04F 13/0846 52/509
3,321,883 A * 5/1967 Pascucci ..... E04F 13/0803 52/774
3,331,180 A * 7/1967 Vissing ..... E04B 9/22 52/715
4,809,470 A * 3/1989 Bauer ..... E04F 13/0801 52/592.1
4,890,433 A * 1/1990 Funaki ..... E04F 13/0801 52/510
4,987,712 A * 1/1991 Mancuso ..... E04F 13/0862 52/387
5,006,011 A * 4/1991 Hiyashi ..... E01C 5/223 52/387
5,373,676 A * 12/1994 Francis ..... E04F 13/0862 52/387

(Continued)

FOREIGN PATENT DOCUMENTS

GB 2331770 A 6/1999
WO WO-2021005245 A1 * 1/2021 ..... E04B 1/4178

*Primary Examiner* — Joshua K Ihezie
(74) *Attorney, Agent, or Firm* — Adler Pollock & Sheehan P.C.

(57) ABSTRACT

A brick tray for securing a brick slip, the tray being a C-shaped channel with a top, a base and a back. The top comprises a downward facing flange with a toothed bottom edge. The base comprises an upward facing flange with the smooth top edge. An uncut brick slip is secured between the toothed bottom edge of the downward facing flange and the smooth top edge of the upward facing flange. The brick tray may include a clip for further securing the brick slip. In this embodiment, the brick slip has a vertical cut on its side edges. Alternatively, the base may have a hemmed edge with two angled arms. The angled arms may face outward toward the tray (concave) or inward toward the tray (convex).

23 Claims, 5 Drawing Sheets

(56) References Cited

U.S. PATENT DOCUMENTS 6,098,363 A * 8/2000 Yaguchi ..... E04F 13/14 52/387
6,421,974 B1 * 7/2002 Whitehouse ..... E04F 13/147 52/510
6,694,694 B2 * 2/2004 Zeeff ..... E04C 2/08 52/510
6,802,165 B1 * 10/2004 Passeno ..... E04F 13/0862 52/387
7,010,894 B1 * 3/2006 Cappelle ..... E04F 13/0826 52/489.1
8,096,091 B2 * 1/2012 Cristina ..... E04F 13/0864 52/551
8,122,683 B1 2/2012 Schwalenberg
8,141,310 B2 * 3/2012 Trezza ..... E04C 2/38 52/302.3
8,935,896 B2 1/2015 Tancredi et al.
8,973,327 B2 * 3/2015 Bouchard ..... E04G 21/1883 52/387
9,016,020 B1 * 4/2015 Yang ..... E04F 13/0803 52/511
9,464,442 B1 10/2016 Olczyk et al.
9,556,618 B2 * 1/2017 Streicher ..... E04F 13/147
9,957,722 B2 5/2018 Taylor, Jr. et al.
D845,515 S 4/2019 Ivosevich
10,731,357 B2 8/2020 Bolin
10,738,476 B2 8/2020 Moghimi
11,293,186 B2 * 4/2022 Prior ..... E04F 13/0862
2004/0065035 A1 * 4/2004 De Vlam ..... E04F 13/0862 52/387
2007/0151190 A1 7/2007 Huff et al.
2010/0095629 A1 4/2010 Taylor
2010/0326010 A1 * 12/2010 Bouchard ..... E04F 13/0862 52/762
2020/0299981 A1 9/2020 Liistro
2022/0243481 A1 * 8/2022 Freeman ..... E04F 13/142

* cited by examiner

Fig. 1
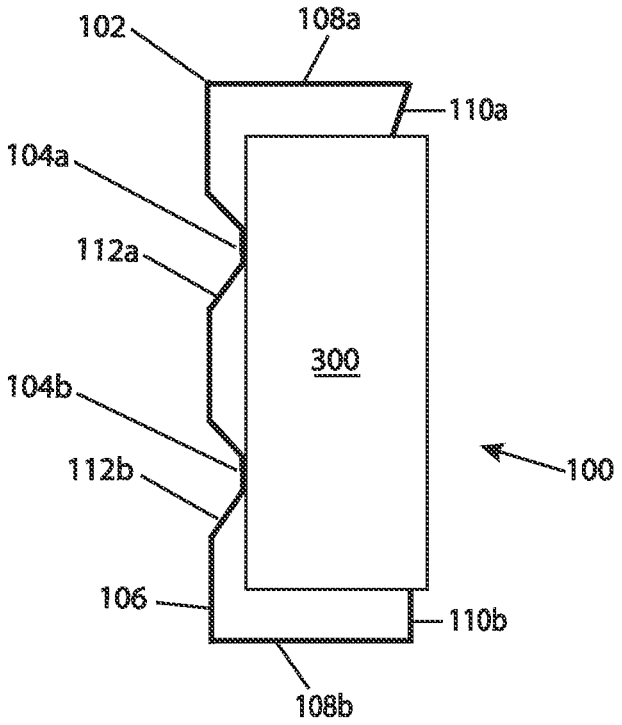
Fig. 2
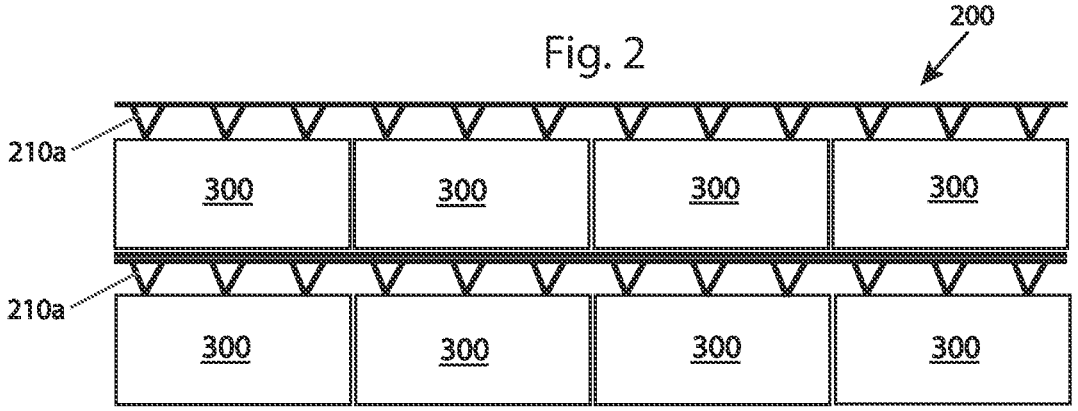
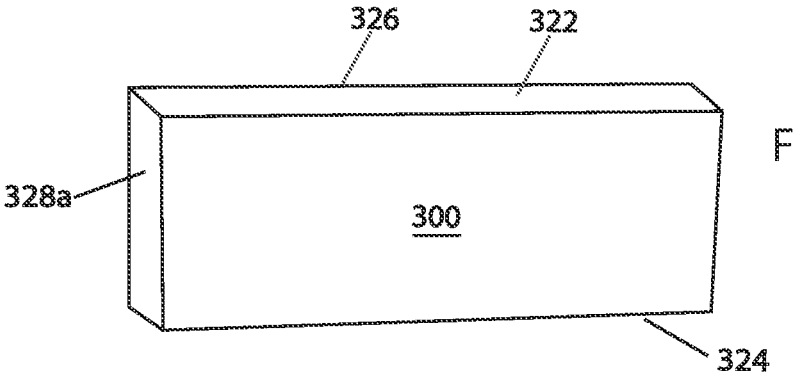
Fig. 3

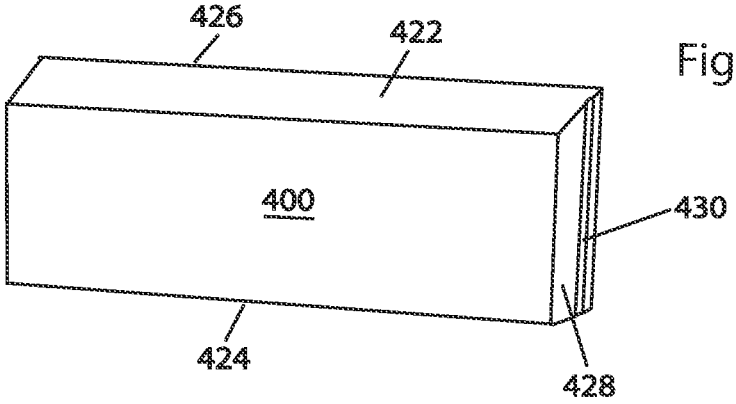
Fig. 4
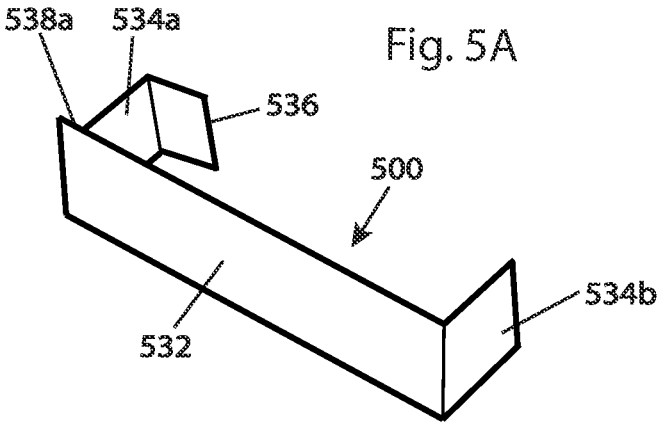
Fig. 5A
Fig. 5B
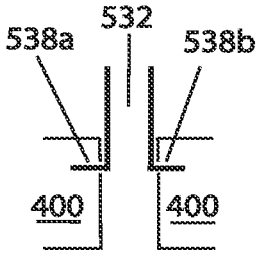
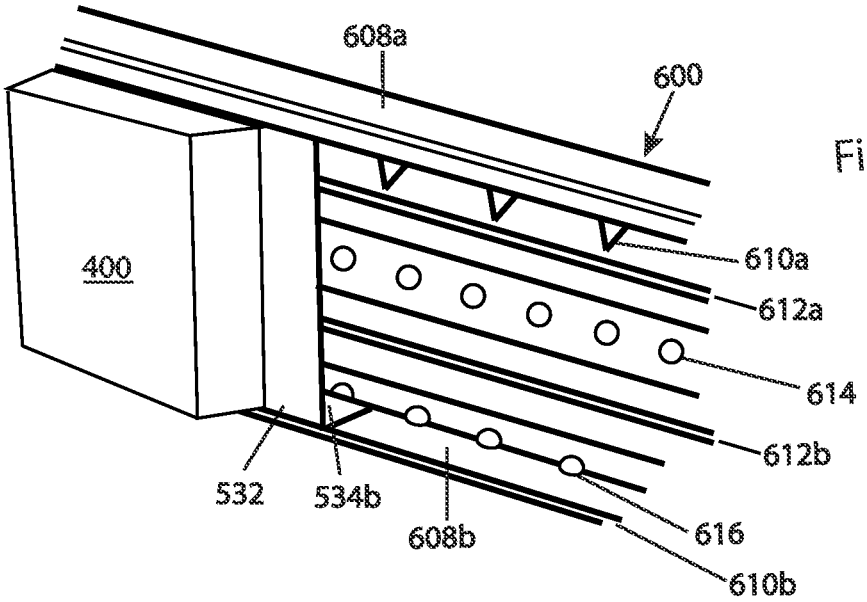
Fig. 6

BRICK TRAY

CROSS-REFERENCE TO RELATED APPLICATIONS

This application claims the benefit of U.S. Provisional Application Ser. No. 63/341,026 filed on May 12, 2022, and U.S. Provisional Application Ser. No. 63/341,033, filed on May 12, 2022, the disclosures of which, in their entireties, are incorporated herein by reference.

BACKGROUND OF THE INVENTION

In general, brick trays use adhesives to hold brick slips in place. However, the use of adhesives increases the cost of materials and labor. In an effort to provide a more cost-effective solution, numerous prior art brick trays are designed for mechanical installation of cut and uncut bricks. For example, U.S. Pat. No. 10,738,476 teaches the use of horizontal rows of spaced-apart tabs with a removeable horizontal bar attached to the tabs—the upper edge and lower edge of the horizontal bar secure the brick slip. It is believed that with this type of configuration, the brick tray provides less than optimal support for the brick slip.

In an effort to increase support, prior art teaches the use of significant modification of the brick slip. For example, in U.S. Pat. No. 8,973,327, the brick tray has similar upper and lower protruding ribs for securing a row of bricks. However, as shown in FIGS. 1A-1F of the '327 patent, the bricks have substantial cuts along their top and/or back surfaces. The use of a substantially cut brick, like the use of adhesive, increases the cost of materials and labor.

SUMMARY OF THE INVENTION

In accordance with one embodiment of the invention, a brick tray securing a brick slip comprises a C-shaped channel having a length; at least one stiffening bar located along a portion of the length of the C-shaped channel; a top, the top having a downward facing flange, the downward facing flange angled inward toward the C-shaped channel and having a toothed bottom edge, the toothed bottom edge having at least one tooth; and a base, the base having an upward facing flange angled perpendicular to the base and having a smooth top edge. The uncut brick slip sits between the toothed bottom edge of the downward facing flange and the smooth top edge of the upward facing flange.

In accordance with a second embodiment of the invention, the brick tray includes a clip for further securing a brick slip. In this embodiment, the brick slip has vertical cuts along its side edges. The first vertical edge of the clip sits within the vertical cut of one brick slip, and the second vertical edge of the clip sits within the vertical cut of a second brick slip.

In accordance with third embodiment of the invention, a brick tray securing a brick slip comprises a C-shaped channel having a length; at least one stiffening bar located along a portion of the length of the C-shaped channel; a top, the top having a downward facing flange, the downward facing flange angled inward toward the C-shaped channel and having a toothed bottom edge, the toothed bottom edge having at least one tooth; and a base, the base having an outside edge that is hemmed, the hem having at least one angled arm with the angled arm extending either outward (away) from the brick tray or inward (toward) the brick tray. A stiffening bar, which also acts as a spacer, straddles the center line of the base.

In an alternate embodiment of the third embodiment of the invention, the hemmed side edge has two angled arms, a top arm and a bottom arm, the top arm securing a first brick slip and the bottom arm securing a second brick slip.

BRIEF DESCRIPTION OF DRAWINGS

The foregoing features of the invention will be more readily understood by reference to the following detailed description and the accompanying views of drawing, in which:

FIG. 1 is a schematic side view of an exemplary embodiment of a brick tray, in accordance with a first embodiment of the invention.

FIG. 2 is a schematic front view of an exemplary embodiment of a brick tray, in accordance with the first embodiment of the invention.

FIG. 3 is a schematic off-set view of an exemplary embodiment of a brick, in accordance with the first and second embodiments of the invention.

FIG. 4 is a schematic off-set view of an exemplary embodiment of a brick for use in association with a second embodiment of the invention.

FIG. 5A is a schematic off-set view of an exemplary embodiment of a clip for use in association with the second embodiment of the invention.

FIG. 5B is a schematic front view of an exemplary embodiment of the clip positioned for use in association with the second embodiment of the invention.

FIG. 6 is a schematic off-set view of an exemplary embodiment of a brick tray, in accordance with the second embodiment of the invention.

DETAILED DESCRIPTION OF THE INVENTION

Figure 7:
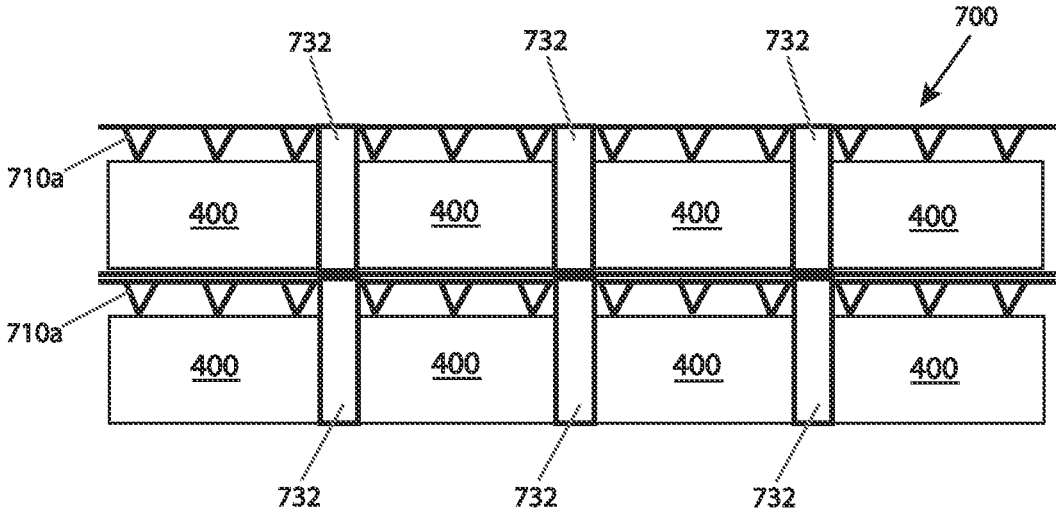
FIG. 7 is a schematic front view of an exemplary embodiment of a brick tray, in accordance with the second embodiment of the invention.

FIG. 1 is a schematic representation of one embodiment of a brick tray. As shown, tray 100 comprises C-shaped channel 102, which comprises back 106, top 108*a* and base 108*b*. Brick slip 300 is uncut. For ease of use, the phrase "brick slip" encompasses other brick industry terminology, for example, brick, brick tile, brick veneer and thin brick. The phrase "uncut brick slip" is used to define a brick slip that has not been modified with, for example, grooves, cuts, kerf cuts, and slots.

Top 108*a* has a downward facing flange, denoted as 110*a*. Top 108*a* and base 108*b* may be between 0.649-0.75 inches-in-depth, and may be longer to accommodate other brick slip sizes. Stiffening bars 112*a* and 112*b* straddle the center line of back 106 and run the length of C-shaped channel 102. The center line of stiffening bar 112*a* may be placed approximately 0.771 inches from base 308*b*, and the center line of second stiffening bar 112*a* may be placed approximately 1.125 inches from the center line of stiffening bar 112*b*. In operation, stiffening bars 112*a* and 112*b* add strength to the tray and serve as contact points for back side 326 of brick slip 300 (shown in FIG. 3) for vertical alignment.

Brick slip 300 sits under, and is secured by, inward facing flange 110*a*. The inward facing flange may be 0.250 inches-in-length. Flange 110*a* may be angled downward at 90 degrees, with an angle of tolerance between 0 degrees and minus 15 degrees. Flange 110*b* is angled upward at 90 degrees, with an angle tolerance between 0 degrees and minus 15 degrees.

The edge of flange 110*a* is toothed and the tooth depths may range between 2.0 mm and 6.0 mm in depth. As a person of ordinary skill understands, the teeth may have varying widths and lengths. The teeth, when in contact with brick slip 300, may be slightly flexed. The edge of flange 110*b* is smooth and provides a uniform seat for brick slip 300.

As shown in FIG. 2, each tray may hold several brick slips stacked in several rows. At least one tooth may grip each brick slip. The teeth may be spaced in even intervals, or staggered intervals, along the edge of the top flange.

FIG. 3 is a schematic representation of brick slip 300. Brick slip 300, which is uncut, comprises top 322, bottom 324, back 326, and sides 328*a* and 328*b*.

In placing brick slip 300 between flanges 110*a* and 110*b*, an operator positions, for example, bottom side 324 of brick slip 300 atop the smooth edge of flange 110*b* and top side 322 of brick slip 300 against the toothed edge of flange 110*a*. Then, the operator uses a mallet to hit brick slip 300 with a downward and inward striking blow, driving top side 322 against the toothed edge of flange 110*a*. Once brick slip 300 is in place, the teeth of flange 110*a* may be flexed and gripping top side 322 of brick slip 300, securing brick slip 300 into place. The striking blow also causes back side 326 of brick slip 300 to rest against contact points 104*a* and 104*b* of stiffening arms 112*a* and 112*b*. As understood by a person of ordinary skill in the art, mortar may be used to further secure the brick slips or to achieve the traditional look of brick veneer.

FIG. 4 is a schematic representation of brick slip 400. Brick slip 400, which has two nominal vertical cuts, comprises top 422, bottom 424, back 426, sides 428*a* and 428*b* and vertical cut 430*a* down side 428*a*, and vertical cut 430*b* down side 428*b*. The width of vertical cuts 430*a* and 430*b* may be 0.25 inches+/−0.0625 inches. The vertical cut is located 0.1875 inches+/−0.0625 inches from back 426, and may extend the height of brick slip 400.

FIG. 5A is a schematic representation of clip 500. Clip 500 comprises front 532, top 534*a*, and base 534*b*. As shown, top 534*a* is located at the top edge of front 532. It comprises flange 536, which may be angled downward at a 90-degree angle from top 534*a*. Further, top 534*a* may be perpendicular to, and narrower than, front 532. In general, top 534*a* may be positioned in line with the vertical centerline of front 532. As understood by a person of skill in the art, the narrower width of top 534*a*, as compared to front 532, forms two horizontal surfaces, denoted as 538*a* and 538*b*, on the top edge of front 532. In turn, base 534*b* is located at the bottom edge of front 532. It may be perpendicular to front 532, or angled inward toward front 532. Base 534*b* may be similar in width to front 532.

FIG. 5B is a schematic representation of clip 500 with horizontal surface 538*a* sitting in vertical cut 430*a* of one brick slip and horizontal surface 538*b* sitting in vertical cut 430*b* of another brick slip.

FIG. 6 is a schematic representation of a second embodiment of the invention. With the exception of clip 500, tray 600 is similar in structure to tray 100. As shown, clip 500 sits between top 608*a* and base 608*b* of tray 600, with front 532 facing away from tray 600 (that is, toward the brick slips). When positioned, top 608*a* and base 608*b* of tray 600 secure clip 500 in tray 600, and clip 500 secures brick slip 400 in place. As described above, the vertical cuts are located 0.1875 inches+/−0.0625 inches from back 426. Thus, in FIG. 6, this posterior portion of brick tray 400 is not visible. Further, in a manner similar to tray 100, brick slip 400 may be secured by the toothed edge of a flange, such a flanges 610*a* and 610*b*.

In placing brick slip 400 between flanges 610*a* and 610*b*, an operator positions, for example, bottom side 424 of brick slip 400 atop the smooth edge of flange 610*b* and top side 422 of brick slip 400 against the toothed edge of flange 610*a*. Then, the operator uses a mallet to hit brick slip 400 with a downward and inward striking blow, driving top side 422 against the toothed edge of flange 610*a*. For the first brick slip in a tray, the operator positions clip 500 between top 608*a* and base 608*b* and near brick slip 400, then slides clip 500 into vertical cut 430*a* (or 430*b*) of the brick slip. For additional brick slips in the tray, the operator positions clip 500 between top 608*a* and base 608*b* and near brick slip 400, then uses the mallet to tap clip 500 into vertical cut 430*a* (or 430*b*) of the brick slip.

As shown in FIG. 7, each tray may hold several brick slips stacked in several rows with clip 500 securing two brick slips (as also shown in FIG. 5B). In an alternate embodiment, brick slip 400 may be secured to tray 700 using clip 500 without the use of flanges, such as flange 710*a*.

Figure 8:
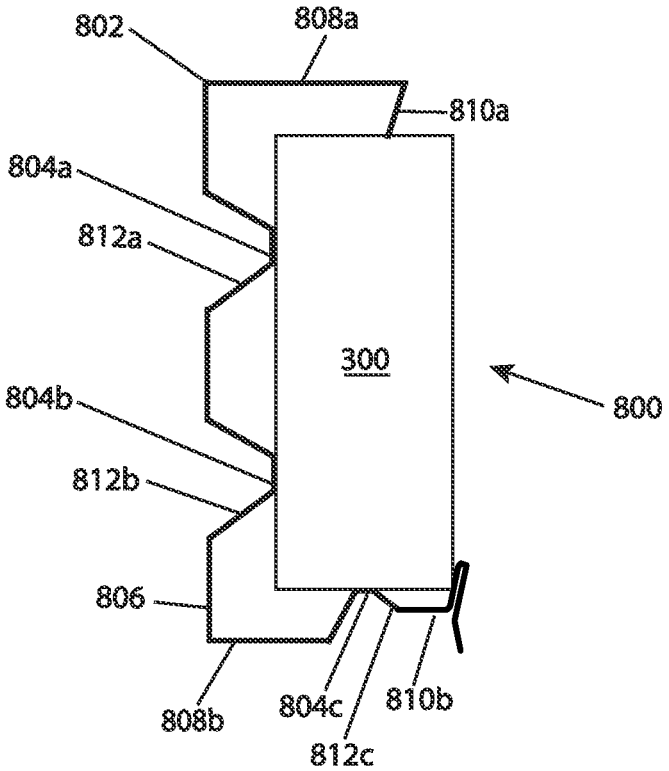
FIG. 8 is a schematic side view of an exemplary embodiment of a brick tray, in accordance with a third embodiment of the invention.

FIG. 8 is a schematic representation of a third embodiment of a brick tray. As shown, tray 800 comprises C-shaped channel 802, which comprises back 806, top 808*a* and base 808*b*. Brick slip 300 is uncut.

Top 808*a* has an inward facing flange, denoted as 810*a*. Stiffening bars 812*a* and 812*b* straddle the center line of back 806 and run the length of C-shaped channel 802. Stiffening bar 812*c*, which also acts as a spacer, straddles the center line of base 608*b*.

Brick slip 300 sits atop stiffening bar 812*c* (at contact point 804*c*) and is secured by inward facing flange 810*a*. The inward facing flange may be 0.250 inches-in-length, and may be angled inward at angles between 3 degrees and 15 degrees.

The bottom edge of flange 810*a* is toothed and the tooth depths may range between 2.0 mm and 6.0 mm. As a person of ordinary skill understands, the teeth may have varying widths and lengths. The teeth, when in contact with brick slip 300, may be slightly flexed.

Flange 810*b*, which is parallel to base 808*b*, comprises a hemmed edge with an angled arm extending below flange 810*b*. The hemmed edge may be flexible, and its angled arm may extend outward—away from the tray (concave) (see FIG. 9A) or it may extend inward-toward the tray (convex) (see FIG. 9B).

Figure 9A:
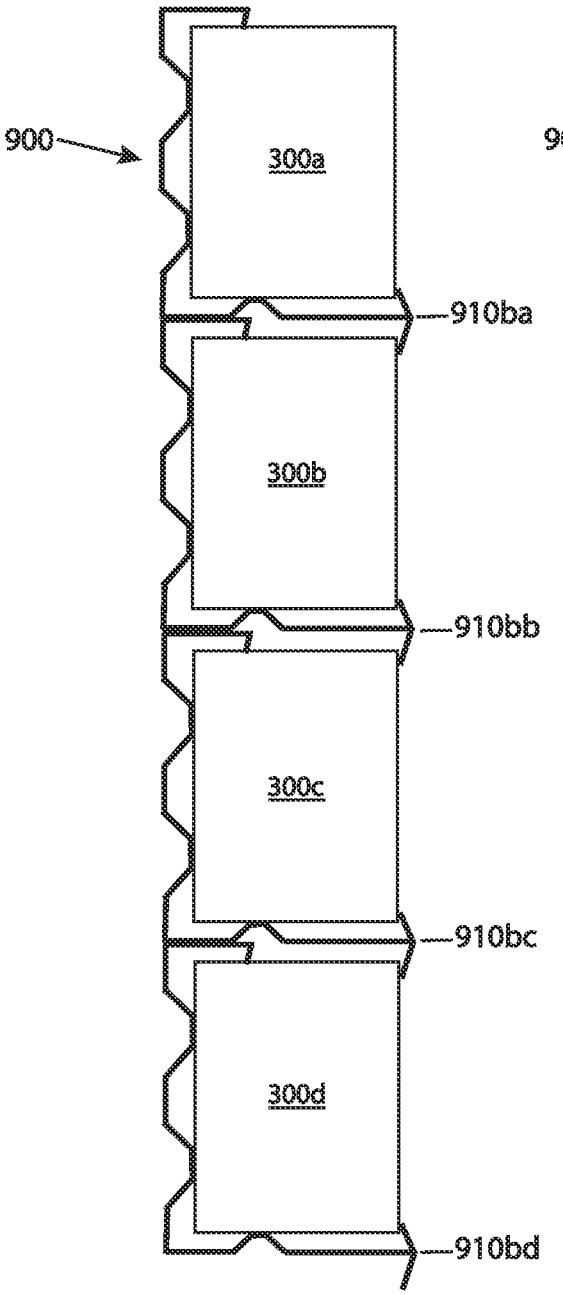
FIGS. 9A and 9B are schematic side views of an exemplary embodiment of a brick tray, in accordance with the third embodiment of the invention

As shown in FIG. 9A, flange 910*ba* holds brick slip 300*a* within tray 900 and secures brick slip 300*b* within the tray 900. In turn, flange 910*bb* holds brick slip 300*b* within tray 900 and secures brick slip 300*c* within tray 900, flange 110*bc* holds brick slip 300*c* within tray 900 and secures brick slip 300*d* within tray 900, and flange 110*bd* holds brick slip 300*d* within tray 900*d* etc. Thus, when all the trays are in place, all of the brick slips may be secured at their respective top and bottom edges.

Figure 9B:
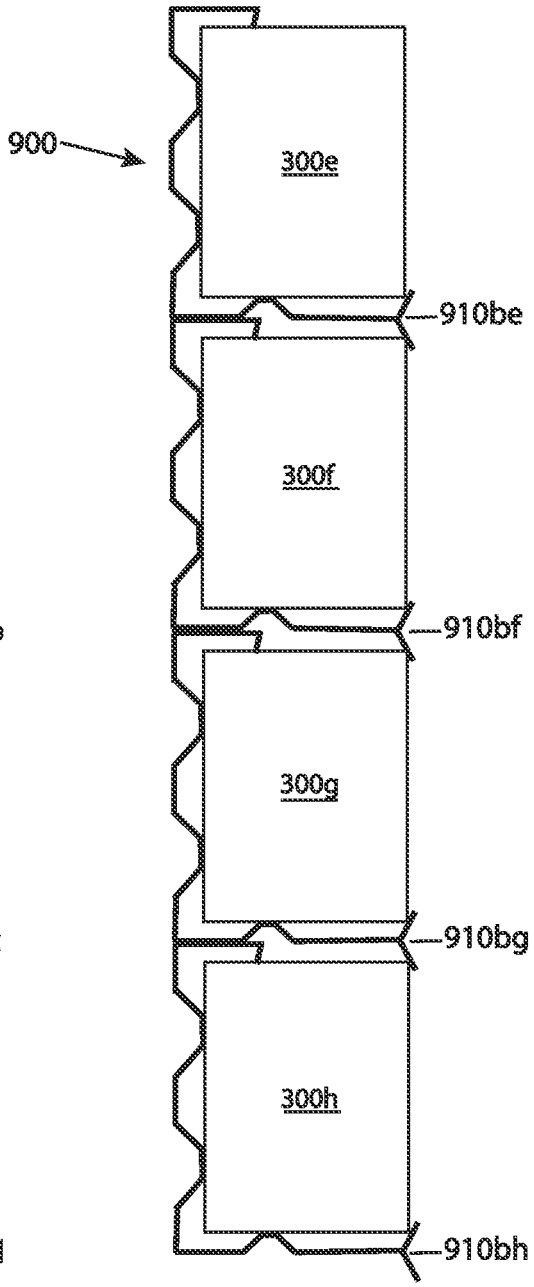

As shown in FIG. 9B, flange 910*be* holds brick slip 300*e* within tray 900 and secures brick slip 300*f* within the tray 900. In turn, flange 910*bf* holds brick slip 300*f* within tray 900 and secures brick slip 300*g* within tray 900, flange

110*bg* holds brick slip 300*g* within tray 900 and secures brick slip 300*h* within tray 900, and flange 110*bh* holds brick slip 300*h* within tray 900 etc. Thus, when all the trays are in place, all of the brick slips may be secured at their respective top and bottom edges.

In placing brick slip 300, an operator positions, for example, bottom side 324 of brick slip 300 into the well formed by base 808*b* and flange 810*b*. Then, the operator uses a mallet to hit brick slip 300 with a downward striking blow, driving brick slip 300 against the toothed edge of flange 810*a*. Once brick slip 300 is in place, the teeth of flange 810*a* are flexed and gripping top 322 of brick slip 300, securing brick slip 300 into place. The striking blow also causes back 426 of brick slip 300 to rest against contact points 804*a* and 804*b* of stiffening arms 812*a* and 812*b*. Bottom 424 rests against contact point 804*c* of stiffening arm 812*c*.

Figure 10:
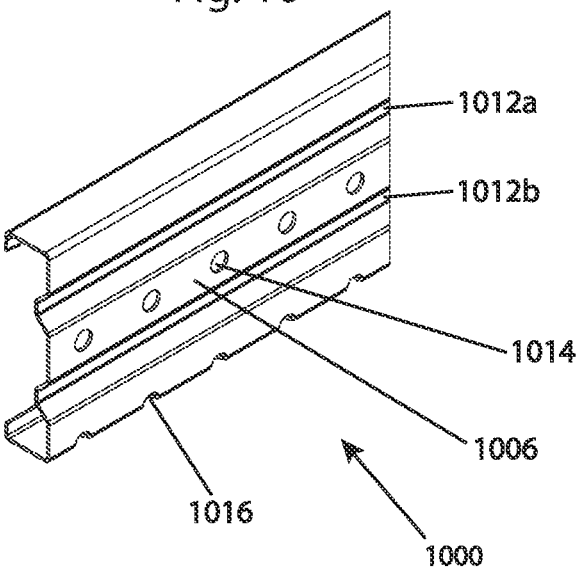
FIG. 10 is a schematic back view of an exemplary embodiment of a brick tray, in accordance with the first, second, and third embodiments of the invention.

FIG. 10 is a schematic representation of the back side of the brick trays described herein. As shown, tray 1000 comprises a C-shaped channel with back 1006 and stiffening bars 1012*a* and 1012*b*. In this embodiment, the C-shaped channel further comprises attachment holes 1014 spaced along the center line of back 1006, and weep holes 1016 spaced along the seam formed by the base of the C-shaped channel and back 1006. The weep holes allow for egress of incidental moisture to maintain water management. The attachment holes and the weep holes may be spaced in even or staggered intervals.

As understood by a person of ordinary skill in the art, one or more measurements of the brick tray described herein may be changed to accommodate brick slips with varying heights and thickness. For example, the brick tray may be configured to accommodate brick slip heights between 1.625 to 3.625 inches-in-height, and/or to accommodate various brick slip thicknesses between 0.5 to 1.0 inches-in-thickness.

The C-shaped channels in the three embodiments of the invention may be made from galvanized steel, coated steel, stainless steel, aluminum or any combination these metals or alloys of these metals.

I claim:

1. A brick tray for securing an uncut brick slip or a cut brick slip, comprising:

a C-shaped channel having a length and a back;

first and second stiffening bars formed integrally with the back and located on opposite sides of a center line of the back, the bars having a space apart between the two;

a top, the top having a downward facing flange, the downward facing flange angled at 90 degrees ±15 degrees to the top and inward toward the C-shaped channel, and having a toothed bottom edge, the toothed bottom edge having at least one tooth;

a base, the base having an upward facing flange angled at 90 degrees ±15 degrees to the base and inward toward the C-shaped channel and having a smooth top edge that is configured to cooperate with the toothed bottom edge to clamp the uncut or cut brick slip;

wherein the first and second stiffening bars provide vertical alignment contact surfaces for the uncut or cut brick slip;

wherein the downward facing flange has a plurality of teeth in staggered intervals along its length, and wherein the brick tray comprises a clip positioned between the top and the base, the clip having a front, a second top angled downward and perpendicular to the front, a second base angled upward and perpendicular to the front, a width of the second top being narrower than the front, the width of the second base equal to the width of the front, and the second top having a flange angled perpendicular to the second top, each side edge of the clip being configured to be received within a vertical cut in adjacent brick slips.

2. The brick tray of claim 1 in which the downward facing flange is angled inward between 0 degrees and 15 degrees to the 90 degrees, and the upward facing flange is angled inward between 0 degrees and 15 degrees to the 90 degrees.

3. The brick tray of claim 1 in which a brick slip sits between the toothed bottom edge of the downward facing flange and the smooth top edge of the upward facing flange.

4. The brick tray of claim 1 in which the tooth is between 2 mm to 6 mm in depth when in contact with an uncut brick slip or a cut brick slip.

5. The brick tray of claim 1 in which the tooth is slightly flexed when in contact with an uncut or a cut brick slip.

6. The brick tray of claim 1, wherein the C-shaped channel comprises the back and further comprises:

a plurality of attachment holes spaced along a center line of the back;

a plurality of weep holes formed along a seam between the base of the C-shaped channel and the back, each weep hole being vertically aligned with a corresponding attachment hole to define a drainage and ventilation path.

7. A brick tray for securing a brick slip, comprising:

a C-shaped channel having a length;

at least one stiffening bar located along a portion of the length of the C-shaped channel;

a top, the top having a downward facing flange angled at 90 degrees to the top and having a smooth bottom edge;

a base, the base having an upward facing flange angled 90 degrees to the base and having a smooth top edge; and a clip, the clip having a front, a second top angled downward and perpendicular to the front, a second base angled upward and perpendicular to the front, the width of the second top being narrower in width than the front, the width of the second base equal to the width of the front, and the second top having a flange angled perpendicular to the second top; the clip sitting between the top of the channel and the base of the channel.

8. The brick tray of claim 7 in which a brick slip comprises a vertical cut along at least one side of the brick slip, a clip having at least one side edge, and the side edge of the clip positioned within the vertical cut of the brick slip.

9. The brick tray of claim 7 in which the brick slip sits between a smooth bottom edge of the downward facing flange and a smooth top edge of the upward facing flange.

10. The brick tray of claim 7 in which the downward facing flange is angled inward between 0 degrees and 15 degrees, and the upward facing flange is angled inward between 0 degrees and 15 degrees.

11. The brick tray of claim 1, wherein the first and second stiffening bars are spaced apart by approximately 1.125 inches or by approximately 28.575 mm; and the toothed bottom edge having the at least one tooth, has the at least one tooth with a depth between 2 mm and 6 mm and being resiliently flexible.

12. The brick tray of claim 11 in which the brick slip sits between the toothed edge of the downward facing flange and the smooth edge of the upward facing flange.

13. The brick tray of claim 11 in which the tooth is between 2 mm to 6 mm in depth.

14. The brick tray of claim 11 in which the tooth is slightly flexed when in contact with the brick slip.

15. The brick tray of claim 11 in which the brick tray further comprises weep holes, the weep holes formed along a seam formed by the base of the C-shaped channel and the back.

16. A brick tray for securing a brick slip, comprising:

a C-shaped channel having a length and a back;

at least one stiffening bar located along a portion of the length of the C-shaped channel;

a top, the top having a downward facing flange, the downward facing flange angled at 90 degrees to the top and having a smooth bottom edge;

a base, the base having a second stiffening bar that straddles a center line of the base, and a hemmed side edge, the hemmed side edge having two angled arms, a top arm and a bottom arm, the top arm being configured to secure a first brick slip and the bottom arm being configured to secure a second brick slip, the angled arms extending selectively outward away from the brick tray or inward toward the brick tray.

17. The brick tray of claim 16 in which the downward facing flange is angled inward between 0 degrees and 15 degrees, and wherein the base further comprises an upward facing flange is-angled inward between 0 degrees and 15 degrees.

18. The brick tray of claim 16 in which a brick slip sits between the smooth bottom edge of the downward facing flange and the second stiffening bar.

19. The brick tray of claim 16, wherein the downward facing flange has a toothed bottom edge comprising a plurality of teeth spaced in staggered intervals along the length of the flange, each tooth having a depth between 2 mm and 6 mm and being resiliently flexible, and wherein the hemmed side edge comprises the two angled arms.

20. The brick tray of claim 19 in which the brick slip sits between the toothed bottom edge of the downward facing flange and the second stiffening bar.

21. The brick tray of claim 19 in which the tooth is between 2 mm to 6 mm in depth.

22. The brick tray of claim 19 in which the tooth is slightly flexed when in contact with the brick slip.

23. The brick tray of claim 16 or 19 in which the brick tray further comprises weep holes, the weep holes formed along a seam formed by the base of the C-shaped channel and the back.

* * * * *